US007228580B2

(12) United States Patent
Dalton

(10) Patent No.: US 7,228,580 B2
(45) Date of Patent: Jun. 12, 2007

(54) UNIVERSAL PILLOW

(75) Inventor: Steve Dalton, Blue Ridge, VA (US)

(73) Assignee: Steven G. Dalton, Blue Ridge, VA (US)

( * ) Notice: Subject to any disclaimer, the term of this patent is extended or adjusted under 35 U.S.C. 154(b) by 0 days.

(21) Appl. No.: 11/327,825

(22) Filed: Jan. 9, 2006

(65) Prior Publication Data

US 2006/0200908 A1 Sep. 14, 2006

Related U.S. Application Data

(60) Provisional application No. 60/644,074, filed on Jan. 14, 2005.

(51) Int. Cl.
*A47G 9/10* (2006.01)

(52) U.S. Cl. ..... 5/636; 5/639; 5/646

(58) Field of Classification Search ..... 5/636, 5/637, 639, 643, 646–648, 650
See application file for complete search history.

(56) References Cited

U.S. PATENT DOCUMENTS

| | | | | |
|---|---|---|---|---|
| 3,883,906 | A * | 5/1975 | Sumpter | 5/632 |
| 5,214,814 | A * | 6/1993 | Eremita et al. | 5/636 |
| 5,604,944 | A * | 2/1997 | Meade | 5/643 |
| 5,644,809 | A * | 7/1997 | Olson | 5/636 |
| 6,336,236 | B1 * | 1/2002 | Dalton | 5/636 |
| 6,640,368 | B2 * | 11/2003 | Roston | 5/648 |

* cited by examiner

*Primary Examiner*—Michael Trettel
(74) *Attorney, Agent, or Firm*—Charles Y. Lackey; Robert W. Pitts

(57) ABSTRACT

A multipurpose pillow serving couple in a relaxed and comfortable when they face each other or when they are in a face-to-back position in bed. The pillow has a body with sides, ends, top and bottom with the bottom having passageways formed by the intersection of one longitudinal and two transverse channels. The channels have first and second end openings and the formed the passages are firm to prevent undue pressure on the arms when they inside the pillow. Multiple opens are available in the pillow to provide variations in positioning the arms inside the pillow.

18 Claims, 15 Drawing Sheets

UNIVERSAL PILLOW

This application is based on Provisional Patent Application Ser. No. 60/644,074 filed Jan. 14, 2005.

BACKGROUND OF THE INVENTION

1. Field of the Invention

The present invention relates to pillows, and more particularly, to a pillow having many uses and which can accommodate one or two people assuming various positions in bed or otherwise.

2. Description of the Prior Art

The pillow of the present invention is an improvement over the pillow shown and claimed in U.S. Pat. No. 6,336,236 by the same inventor, the contents of which are expressly incorporated herein by reference.

The use of one pillow for two or more people is not widely practiced, and even if such a feature is claimed, many times the resulting product is really two separate pillow joined together to simulate a single pillow. In the earlier patent referenced above, very little close prior was cited during prosecution and little additional art has been noted.

The pillow in the referenced patent was designed to be shared by a couple, to allow them to face each other, and to accommodate their arms and legs so that blood circulation was not adversely impacted. There is a need to have more of such products readily available, and it is to that continuing need that the present invention is directed.

SUMMARY AND OBJECTIVES OF THE INVENTION

The present invention is for a multipurpose pillow primarily to serve a couple in a relaxed and comfortable manner when they face each other in bed or when they are in the "spoon" position in bed, since these positions without an aid of some sort become very uncomfortable after a period of time. To provide the assistance needed, the pillow of the present invention has a pillow body with two sides, 2 ends, a top and a bottom. The bottom is configured with a plurality of passageways formed by creating at least one longitudinal channel and at least two transverse channels at right angles to the longitudinal channel. Each channel has a first opening and a second opening and is described with respect to the vertical surfaces which they engage. If a channel extends from end-to-end, the portion of the channel at the beginning or end of the channel is described as the first end opening or second end opening.

The use of the pillow is reflected in schematic drawings detailing the movement of the arms of the couple as they position themselves with respect to each other. When an arm is extended within portions of the channels, there is no discomfort experienced since the structure of the pillow body resists a closing of the channel portion on such an extended arm. Because of this characteristic, there is no discomfort from one arm pressing against another or no restriction of blood flow resulting from the weight of the body on a pinned arm.

Three basic positions represent the primary configurations used by the couple with the pillow. In a reclined, face-to-face position, each party's lowermost arm enters each transverse channel's first side opening. That beginning passageway extends upwardly crossing the longitudinal channel and on to and through each transverse channels' second side opening. The arms can either remain in the second side openings or extend outward therefrom free from engagement with the second side openings. Since the arms of both members of the couple are free, they can hold hands in a very restful position.

In a face-to-back position, often referred to as the "spoon" position, the lowermost arm of the party member lines up with the second transverse channel goes into and through the transverse channel first side opening, crosses the longitudinal channel and goes into and through first transverse channel second side opening and out of the pillow. The other partner's lowermost arm goes into the first transverse channel first side opening and then into and through the longitudinal channel first end opening and out of the pillow.

In another face-to-back position, the lowermost arm of the second transverse channel aligned party goes into and through the second transverse channel first side opening and then to and out of the longitudinal channel first end opening.

Other combinations are possible and will be apparent when the drawings are reviewed and studied.

From the foregoing summary, it will be obvious that a primary objective of the present invention is to provide a universal pillow for use by one individual or by two individuals to achieve frontal closeness while lying on their sides and facing each other.

Another objective of the present invention is to provide a pillow for use by two individuals positioned in a face-to-back position to achieve general closeness while lying on their sides.

Yet another objective of the present invention is to provide a pillow for use by two individuals positioned in a face-to-back position to achieve another form of general closeness while lying on their sides.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for caring out the several purposes of this development. It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objectives of the invention set forth above, along with the various features of novelty, which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

The drawings are included to provide a further understanding of the invention and are incorporated in and constitute a part of this specification. They illustrate embodiments of the invention and, together with their description, serve to explain the principles of the invention.

DETAILED DESCRIPTION OF PREFERRED EMBODIMENT

Figure 1:
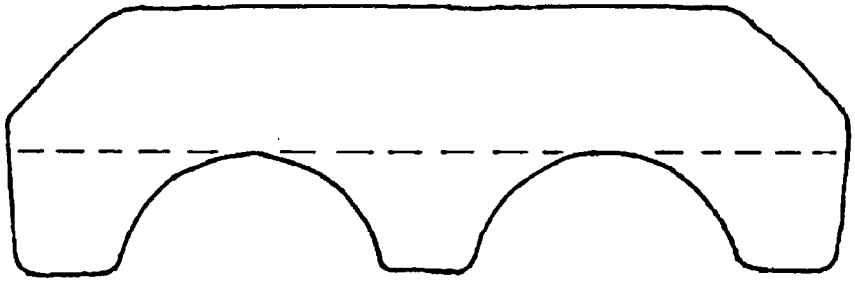
FIG. 1 is a side elevational perspective view of a pillow body of a first embodiment of the present invention.
Figure 2:
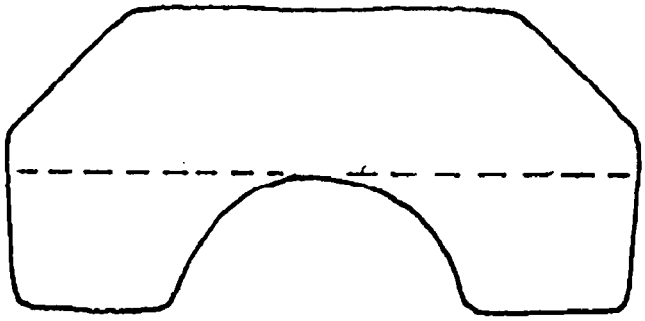
FIG. 2 is an end elevational view of the pillow body of shown in FIG. 1.
Figure 3:
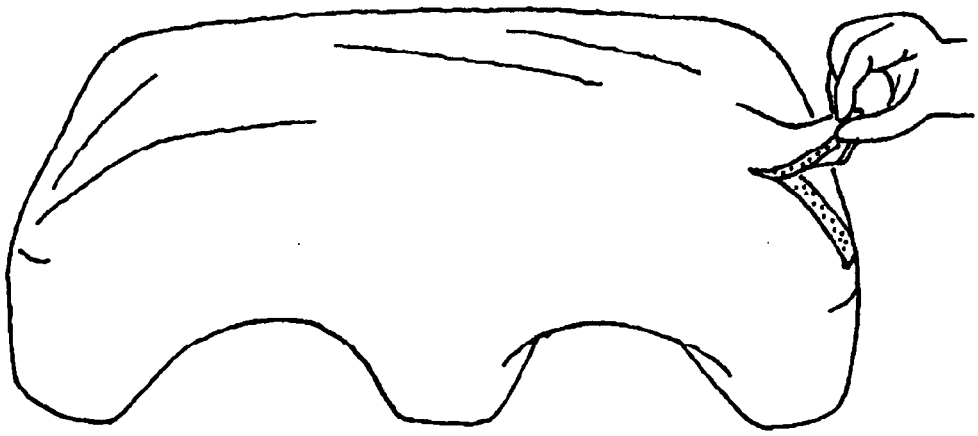
FIG. 3 is a perspective view of the pillow body of FIGS. 1 and 2 being covered by a decorative and protective pillow cover.

Referring now to the drawings, FIG. 1 is a side elevational perspective view of the pillow designated generally as 20 showing the first and second transverse channels 22, 24. FIG. 2 is an end elevational perspective view of the pillow. Pillow 20 has a pillow cover 26 covering a body 28 which is made up of two or more foam layers with the inner layers being firm and the outer layer preferably being of a memory foam. Cover 26 may be closed and held in place by the use of any number of securing devices with hooks and loops being shown in FIG. 3.

Figure 4:
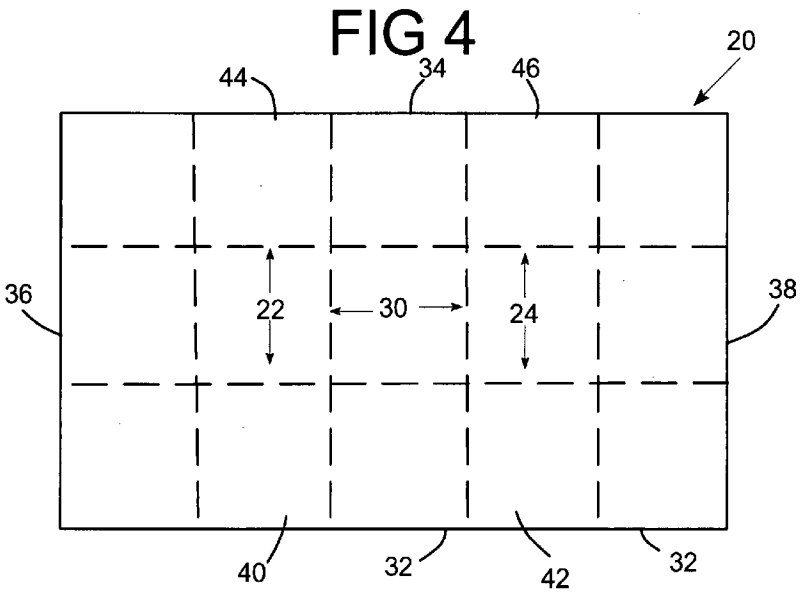
FIG. 4 is a plan schematic of the pillow structure of FIGS. 1-3 showing the longitudinal and transverse channels and related components in hidden lines.

FIG. 4 is a plan schematic view of the pillow structure showing in hidden lines transverse channels 22, 24 and a longitudinal channel 30 extending the length of pillow 20 and substantially parallel to the first side 32 and second side 34 of pillow 20. First and second ends 36, 38 are substantially parallel to first and second transverse channels 22, 24. First and second transverse channels 22, 24 have first side openings 40, 42 and second side openings 44, 46. First side openings 40, 42 provide entrances from the outside to the inner part of pillow 20. Second side openings 44, 46 are open passages from the inside of pillow 20 to the outside.

Figure 5:
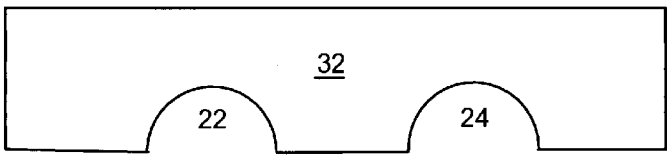
FIG. 5 is a side elevational view of the pillow body shown in FIGS. 1-3.

FIG. 5 is a side elevational schematic view of the pillow structure of FIG. 4 and clearly shows transverse channels 22, 24.

Figure 6:
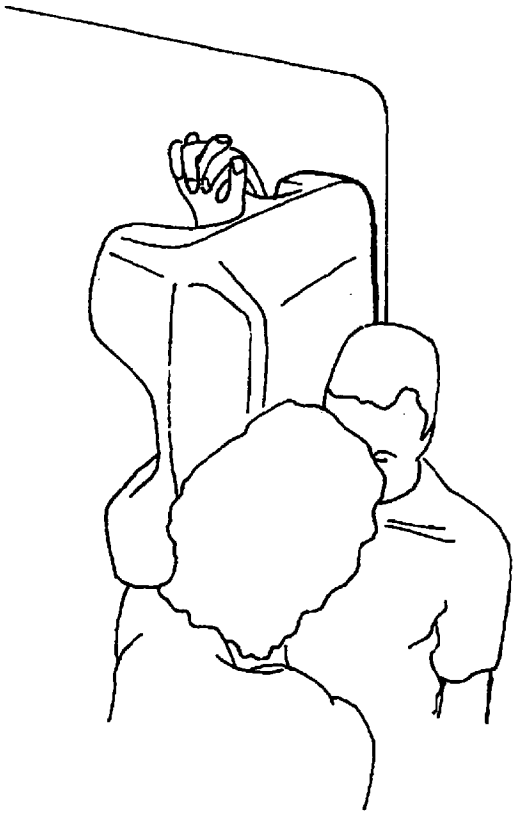
FIG. 6 is a perspective view of a couple in a face-to-face reclining position utilizing the pillow of the present invention.

FIG. 6 shows pillow 20 being used by a couple (the partners 48, 50) in the face-to-face position. The lowermost arm of each partner extends into pillow 20 with the right arm of the first partner 48 going into the pillow interior through first side opening 42 and the left arm of the second partner 50 entering pillow 20 through first side opening 40. The arms of both partners 48, 50 extend upwardly through transverse channels 22, 24 to second side openings 44, 46. The arms can remain within openings 44, 46 or can extend upwardly to the outside where they may join.

Figure 7:
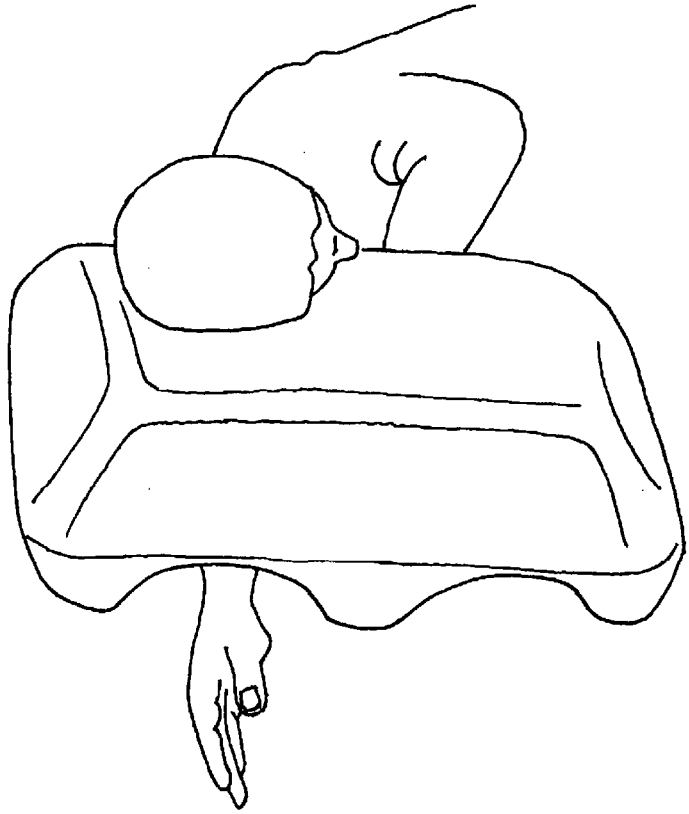
FIG. 7 is a perspective view of one person utilizing the pillow of the present invention.

FIG. 7 shows pillow 20 being used by one partner 50. This use is like that shown in FIG. 4 with the lowermost arm extending upwardly and out of pillow 20 through second side opening 46. Since there are five other openings in pillow 20, partner 50 has a wide range of usage.

Figure 8:
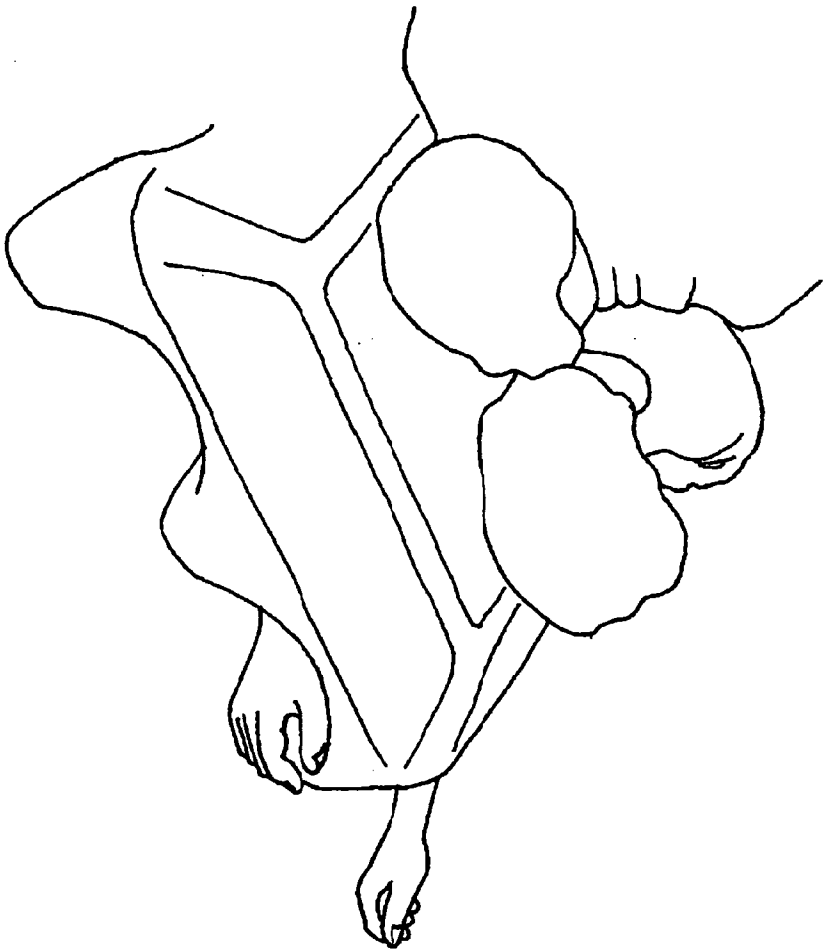
FIG. 8 is a perspective of a couple utilizing the present invention in a spoon position.

FIG. 8 shows partners 48, 50 using pillow 20 in the face-to-back or "spooning" position. Here partner 50 enters pillow 20 through first side opening 42 of transverse channel 24. Partner 50 then crosses longitudinal channel 30 and extends to second side opening 44 and then on to the outside if the partner so chooses. Partner 48 enters pillow 20 through first side opening 32 of transverse channel 22, extends to first end opening 36 of longitudinal channel 30 and then to the outside. In this position, both partners 48, 50 can extend their arms through the channels of pillow 20 very comfortably without experiencing any pressure.

In a variation of this example, partner 48 enters pillow 20 through first side opening 32 of transverse channel 24 and extends to the outside through first end opening 36 of longitudinal channel 30 as in the previous example, however partner 50 enters pillow 20 as described before, however partner 50 exits through first end opening 36 of longitudinal channel 30.

Figure 9:
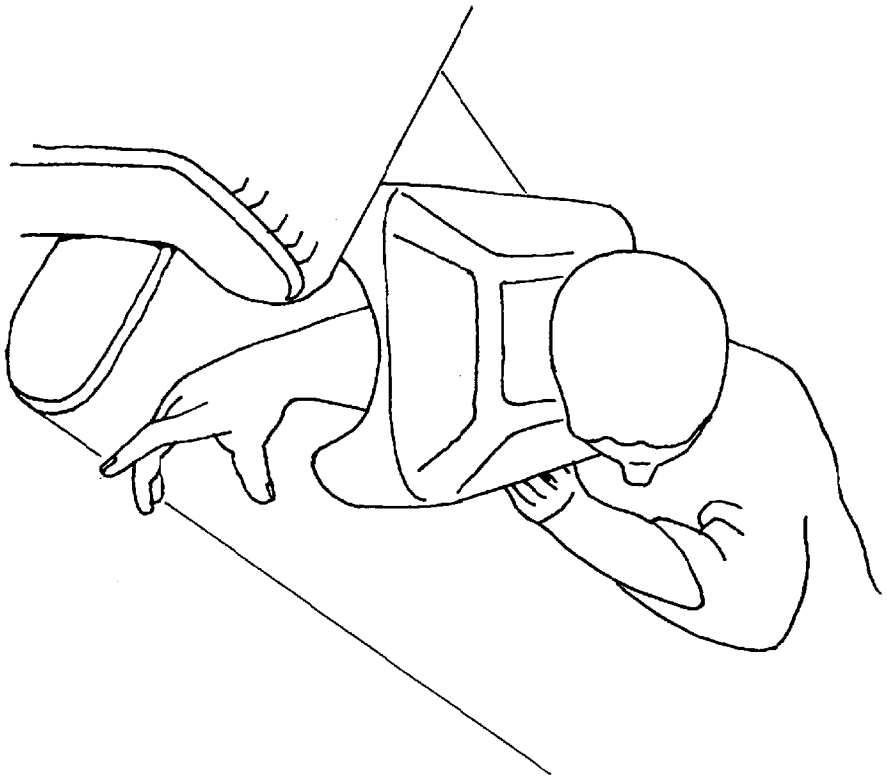
FIG. 9 is a perspective view of one person using another couch type embodiment of the present invention.

FIG. 9 illustrates the couch type alternative embodiment of the present invention. Here a smaller pillow 52 has a main cross channel 54 through which a user 56 positions his arm as shown. In this version, pillow 52 has a total of four openings.

Figure 10:
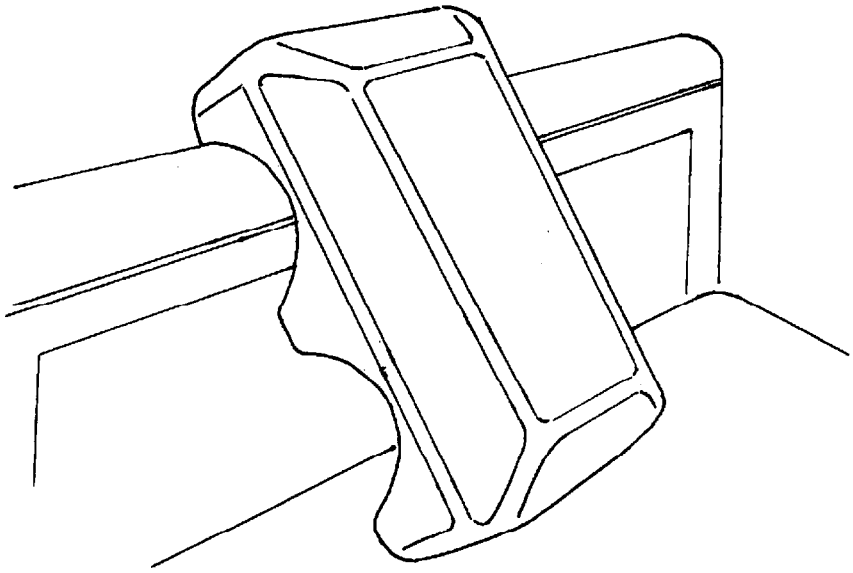
FIG. 10 is a perspective view of the primary embodiment of the present invention being used as a back support.

FIG. 10 shows pillow 20 being used as a back support. In this example, first end 36 engages the top 58 of a headboard 60 and the divider 62 helps maintain pillow 20 in a supporting position.

Figure 11:
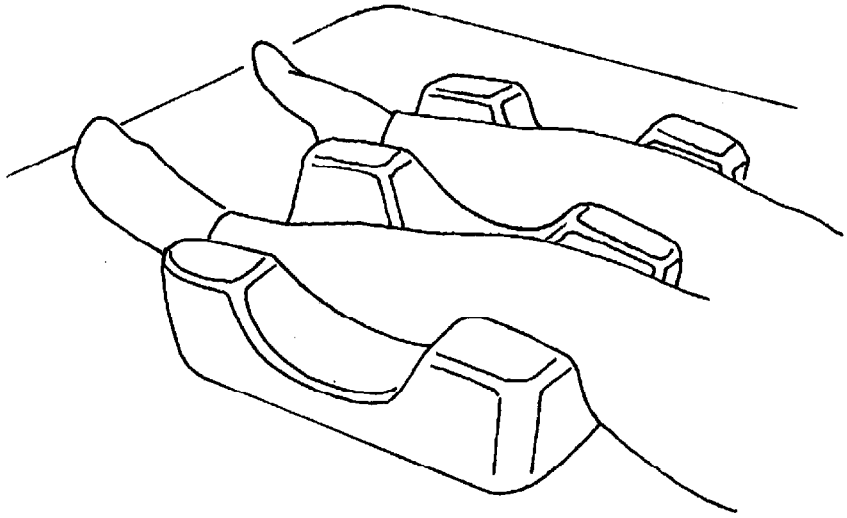
FIG. 11 is a perspective view of the primary embodiment of the present invention being used as a leg elevator and stabilizer.

FIG. 11 shows pillow 20 being used as a cervical collar or neck support. A user 64 positions the head and neck in the inverted pillow as shown in the drawing.

Figure 12:
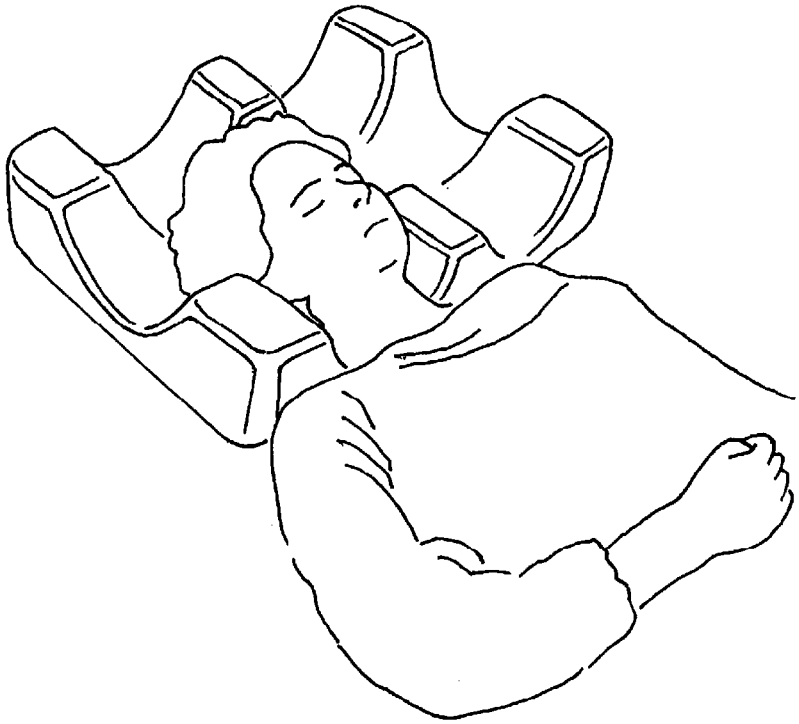
FIG. 12 is a perspective view of the primary embodiment of the present invention being used as a cervical support and neck stabilizer.

FIG. 12 shows pillow 20 being used as a leg support elevating the legs to relieve discomfort. In all embodiments, a vibrator can be utilized to further relieve discomfort. Such an instrument may be embedded in the foam of pillows 20 and 52 or applied directly to the neck or shoulders.

Figure 13:
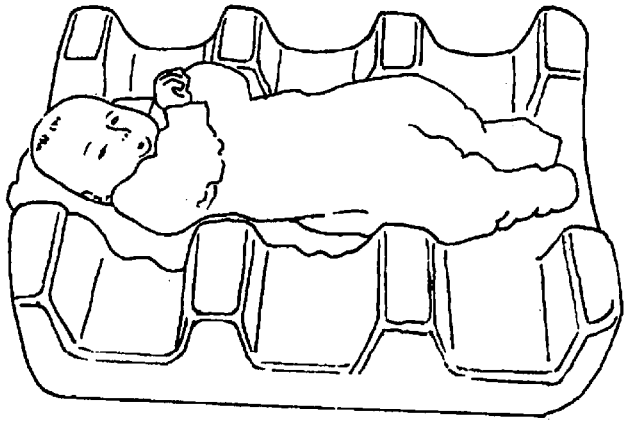
FIG. 13 is a perspective view of the primary embodiment of the present invention being used as a daytime baby support pillow.

FIG. 13 shows pillow 20 being used as a daytime baby support pillow, the bottom shaped surface forming a natural recess for holding the baby in a substantially fixed but comfortable position. The upper surface can be made substantially flat to ensure that pillow 20 and its other embodiments will be stable while supporting the enfant.

Figure 14:
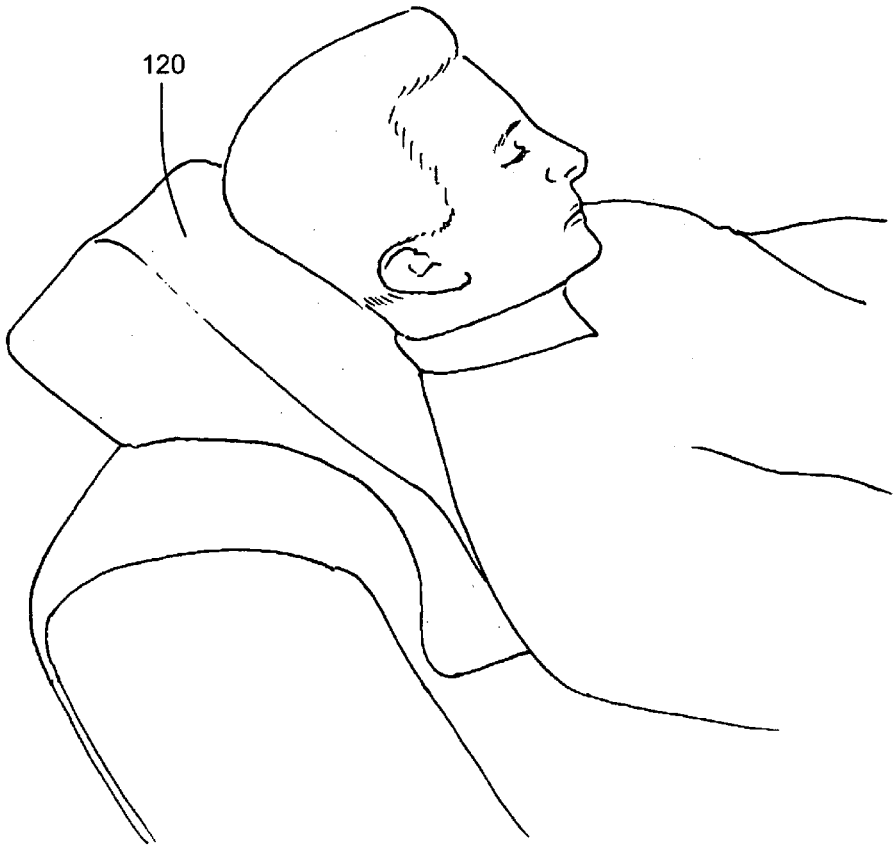
FIG. 14 is a perspective view of the couch type embodiment of the present invention being used as a head and back support.
Figure 15:
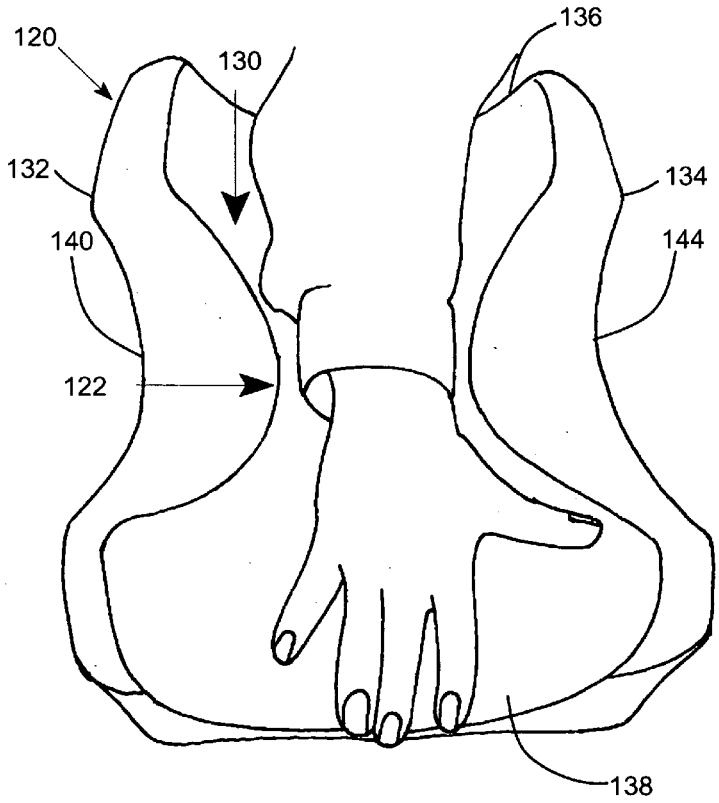
FIG. 15 is a perspective view of the couch type embodiment of the present invention being used as a hand stabilizng pillow to assist stroke victims in keeping the hand in the bottom of the pillow to extend the thumb and pinky fingers outward to avoid curling of the hands.
Figure 16:
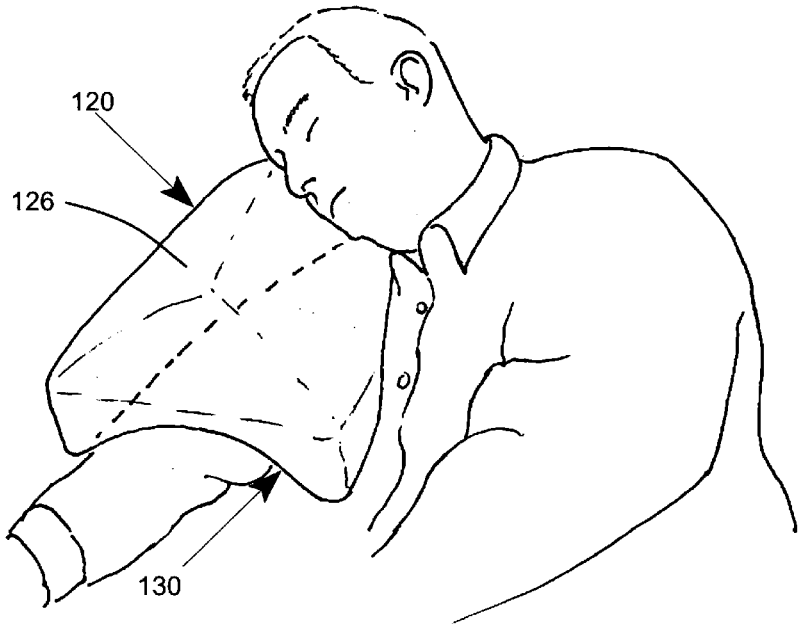
FIG. 16 is a perspective view of the couch type embodiment of the present invention being used as a sleep aid in a vehicle.

FIGS. 14-16 show similar and other uses of the couch type embodiment of the present invention. Couch type pillow 120 has one transverse channel 122 intersecting one longitudinal channel 130. Transverse channel 122 has a first side opening 140 and a second side opening 144. As shown in FIG. 15, channels 122 and 130 intersect in the middle of the pillow 120 substantially equidistant the opposite ends of each channel Pillow 120 has first and second sides 132, 134, a first end 136 and a second end 138 As best seen in FIG. 15, transverse channel 122 is substantially equidistant between the first end 136 and the second end 138. Longitudinal channel 130 is substantially equidistant the first and second sides 132 and 134. As shown in FIG. 16, pillow 120 has a cover 126.

From the preceding description, it can be seen that a universal pillow has been provided that will meet all of the advantages of prior art devices and offer additional advantages not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. A pillow for use by two users comprising: a pillow body having first and second sides, first and second ends, a top and a bottom, the bottom exposing at least one longitudinal channel extending for the length of and substantially parallel to the first and second sides and having a first end opening and a second end opening, and at least first and second transverse channels extending for the width of and substantially parallel to the first and second ends and each having a first transverse channel side opening and a second transverse channel side opening, the at least one longitudinal channel intersecting the at least two transverse channels, the two transverse channels being in sufficient proximity to form passageways open on opposite ends in combination with the longitudinal channel through which a user's arm can extend, so that a first user arm extending through said second transverse channel first side opening can be extended to pass through the longitudinal channel and emerge from the first transverse channel second end opening, and a second user arm extending through first transverse channel first side opening can emerge from longitudinal channel first end opening whereby the pillow allows the users to lie with their arms within the pillow and their heads supported by the pillow with no adverse impact upon blood circulation.

2. The pillow as claimed in claim 1 wherein the width of the pillow is sufficient to permit the users to lie in a spoon position.

3. The pillow as claimed in claim 1 wherein the channels are configured to permit a first user arm to extend from the second transverse channel first end opening through the longitudinal channel to the second transverse channel second end opening, and a second user arm to extend from the first transverse channel first end opening through the longitudinal channel to the first transverse channel second end opening whereby the pillow allows the users to lie in a face-to-face position with arms within the pillow and heads supported by the pillow with no negative effect on blood circulation.

4. The pillow as claimed in claim 3 wherein the channels are configured to permit the users to extend their arms from the first and second transverse channel second end openings and out of the pillow.

5. The pillow as claimed in claim 4 wherein the pillow is configured to permit the users to hold hands when their arms extend from the first and second transverse channel second end openings.

6. The pillow as claimed in claim 1 wherein the channels are configured so that when the first user arm is extended from the first transverse channel second side opening, and the second user arm is extended from the longitudinal channel first end opening the users may be in the spoon position.

7. The pillow as claimed in claim 6 wherein the pillow is configured so that the users can hold hands when their arms extend from the first transverse channel second end opening and from the longitudinal channel first end opening.

8. A pillow for multiple uses comprising: a pillow body having first and second sides, first and second ends, a top and a bottom, the bottom having at least one longitudinal channel extending for the length of and substantially parallel to the first and second sides and having a first end opening and a second end opening, and at least one transverse channel extending for the width of and substantially parallel to the first and second ends and having an at least one transverse channel first side opening and second side opening, the at least one longitudinal channel intersecting the at least one transverse channel and forming passageways so that a user arm extending through the at least one transverse channel first end opening can be again extended to emerge from the longitudinal channel first end opening whereby the pillow allows the user to lie down with an arm within the pillow and portions of the pillow surrounding the at least one longitudinal channel and the at least one transverse channel comprise means for supporting the head with no adverse impact on blood circulation.

9. The pillow of claim 8 wherein the pillow includes only a single longitudinal channel and a single transverse channel.

10. The pillow of claim 9 wherein the longitudinal channel and the transverse channel intersect at the center of the bottom of the pillow.

11. The pillow of claim 9 wherein the longitudinal channel has a diameter sufficient for supporting the pillow on an arm of a couch.

12. The pillow of claim 8 including a protective cover and a separate decorative cover.

13. A pillow for use by two users comprising: a pillow body having first and second sides, first and second ends, a top and a bottom exposing at least one longitudinal channel extending for the length of and substantially parallel to the first and second sides having a first end opening and a second end opening, and at least first and second transverse channels extending for the width of and substantially parallel to the first and second ends and each having a first transverse channel side opening and a second transverse channel side opening, the at least one longitudinal channel intersecting the at least two transverse channels, the two transverse channels being in sufficient proximity to form passageways open on opposite ends in combination with the longitudinal channel through which a user's arm can extend, so that a first user arm extending through second transverse channel first side opening can be extended to pass through the longitudinal channel and enter and pass through the longitudinal channel first end opening, and a second user arm extending through first traverse channel first side opening can emerge from longitudinal channel first end opening whereby the pillow allows the users to lie with their arms within the pillow and their heads supported by the pillow with no adverse impact upon blood circulation.

14. A pillow for multiple uses comprising: a pillow body having first and second sides, first and second ends, a top and a bottom, the bottom having a longitudinal channel extending for the length of and substantially parallel to the first and second sides and having a first end opening and a second end opening, and a transverse channel extending for the width of and substantially parallel to the first and second ends and having an at least one transverse channel first side opening and second side opening, the at least one longitudinal channel intersecting the at least one transverse channel and forming four passageways with exterior openings each passageway being large enough for receive a user arm extending therethrough, with the longitudinal channel and the transverse channel being is sufficiently close proximity so that a user arm can pass through any passageway formed by a combination of sections of the longitudinal channel and the transverse channel.

15. The pillow of claim 14 wherein the longitudinal channel is large enough so that the pillow may be supported on a couch with a portion of an arm of the couch received within the longitudinal channel.

16. A pillow for multiple uses comprising: a pillow body having first and second sides, first and second ends, a top and a bottom, the bottom having a longitudinal channel extending for the length of and substantially parallel to and substantially equidistant from the first and second sides and having a first end opening and a second end opening, and a transverse channel extending for the width of and substantially parallel to and substantially equidistant from the first and second ends and having a transverse channel first side opening and second side opening, the longitudinal channel intersecting the transverse channel substantially equidistant the opposite ends of each channel and forming passageways so that a user arm extending through the transverse channel first end opening can be again extended to emerge from the longitudinal channel first end opening, whereby the pillow allows the user to lie down with an arm within the pillow with no adverse impact on blood circulation.

17. A pillow for multiple uses comprising: a pillow body having first and second sides, first and second ends, a top and a bottom, the bottom having a longitudinal channel extending for the length of and substantially parallel to the first and second sides and having a first end opening and a second end opening, and a transverse channel extending for the width of and substantially parallel to the first and second ends and having a transverse channel first side opening and second side opening, the longitudinal channel intersecting the transverse channel and forming passageways so that a user arm extending through the transverse channel first end opening can be again extend to emerge from the longitudinal channel first end opening whereby the pillow allows the user to lie down with an arm within the pillow with no adverse impact on blood circulation, the pillow being formed by an inner foam layer and an outer foam layer, the inner foam layer being firmer than the outer foam layer and the outer foam layer being formed of a memory foam.

18. The pillow of claim 17 including a cover surrounding the foam layers.

* * * * *